US009238238B2

(12) United States Patent
Cordua

(10) Patent No.: US 9,238,238 B2
(45) **Date of Patent: *Jan. 19, 2016**

(54) ROTATING SPRINKLER HEAD VALVE

(71) Applicant: Paul M. Cordua, Lindsay, CA (US)

(72) Inventor: Paul M. Cordua, Lindsay, CA (US)

( * ) Notice: Subject to any disclaimer, the term of this patent is extended or adjusted under 35 U.S.C. 154(b) by 72 days.

This patent is subject to a terminal disclaimer.

(21) Appl. No.: 14/084,921

(22) Filed: Nov. 20, 2013

(65) Prior Publication Data

US 2014/0076997 A1 Mar. 20, 2014

Related U.S. Application Data

(63) Continuation of application No. 13/474,500, filed on May 17, 2012, now Pat. No. 8,608,092, which is a continuation of application No. 12/639,933, filed on Dec. 16, 2009, now Pat. No. 8,205,811, which is a continuation of application No. 11/950,305, filed on Dec. 4, 2007, now Pat. No. 7,654,474.

(51) Int. Cl.

| | |
|---|---|
| ***B05B 1/32*** | (2006.01) |
| ***B05B 3/04*** | (2006.01) |
| ***B05B 1/30*** | (2006.01) |
| ***B05B 3/02*** | (2006.01) |

(52) U.S. Cl.

CPC ..... *B05B 3/049* (2013.01); *B05B 1/3026* (2013.01); *B05B 3/021* (2013.01); *B05B 3/0427* (2013.01)

(58) Field of Classification Search

CPC ..... B05B 3/0422; B05B 1/06; B05B 1/30; B05B 3/049; B05B 3/021; B05B 3/0427; B05B 1/3026

USPC ..... 239/200–206, 237, 246, 247, 263, 381, 239/382, 451, 542, 456–458, 460, DIG. 1, 239/380, 383, 225.1, 231, 238, 240, 505, 239/513, 523

See application file for complete search history.

(56) References Cited

U.S. PATENT DOCUMENTS

| | | | |
|---|---|---|---|
| 1,510,930 | A | 10/1924 | Enell |
| 4,579,285 | A | 4/1986 | Hunter |
| 5,058,806 | A | 10/1991 | Rupar |
| 5,288,022 | A | 2/1994 | Sesser |
| 5,556,036 | A | 9/1996 | Chase |
| 6,145,758 | A | 11/2000 | Ogi et al. |
| 6,244,521 | B1 | 6/2001 | Sesser |
| 6,499,672 | B1 | 12/2002 | Sesser |

(Continued)

OTHER PUBLICATIONS

Rain Bird Tech Specs, Rain Bird Corporation, May 2004, pp. 1-4.

(Continued)

*Primary Examiner* — Jason Boeckmann

(74) *Attorney, Agent, or Firm* — Fulwider Patton LLP

(57) ABSTRACT

The rotating sprinkler head valve includes an upper assembly with a stationary rigid cone received in a conical interior chamber of a rotor, and a cylindrical shaft extending through the stationary rigid cone and rotor. A lower assembly includes a bottom helix member, a strainer adapter having an internal transverse slotted plate and a rotatable slotted flow plate to permit flow when the flow plate slots are aligned with slots in the internal transverse slotted plate. A base top member includes a downwardly extending inner tubular portion and a lower interior edge surface with a helical lower surface forming an adjustable helical aperture in cooperation with the bottom helix member, and a recessed inner helical lip is configured to receive the upper helical surface of the bottom helix member for adjusting a helical aperture.

18 Claims, 12 Drawing Sheets

(56) References Cited

U.S. PATENT DOCUMENTS

| | | | | |
|---|---|---|---|---|
| 6,651,905 | B2 | 11/2003 | Sesser et al. | |
| 6,688,539 | B2 | 2/2004 | Vander Griend | |
| 6,736,332 | B2 | 5/2004 | Sesser et al. | |
| 6,769,633 | B1 | 8/2004 | Huang | |
| 7,032,836 | B2 | 4/2006 | Sesser et al. | |
| 7,303,153 | B2 | 12/2007 | Han et al. | |
| 7,429,005 | B2 | 9/2008 | Schapper et al. | |
| 7,654,474 | B2 * | 2/2010 | Cordua | 239/457 |
| 8,205,811 | B2 * | 6/2012 | Cordua | 239/457 |
| 2005/0082387 | A1 | 4/2005 | Onofrio | |

OTHER PUBLICATIONS

The Intelligent Use of Water, Rain Bird Corporation, Dec. 2006, pp. 1-2.

* cited by examiner

ROTATING SPRINKLER HEAD VALVE

CROSS-REFERENCE TO RELATED APPLICATIONS

This continuation application is based upon and claims the benefit of priority from the prior U.S. patent application Ser. No. 13/474,500, filed on May 17, 2012, now U.S. Pat. No. 8,608,092, which is based on U.S. patent application Ser. No. 12/639,933, filed on Dec. 16, 2009, U.S. Pat. No. 8,205,811, issued on Jun. 26, 2012, which is based on U.S. patent application Ser. No. 11/950,305, filed on Dec. 4, 2007, U.S. Pat. No. 7,654,474, issued on Feb. 2, 2010, the entire content of which is incorporated herein by reference.

BACKGROUND OF THE INVENTION

This invention relates generally to irrigation sprinklers or spray heads, and more particularly relates to a rotating nozzle for a common pop up sprinkler, used for landscape and turf irrigation.

An adjustable orifice sprinkler is known that provides an adjustable arc spray orifice for adjusting a spray pattern angle approximately zero to 360 degrees, and a cap adjustable axially for selectively adjusting the height of the spray orifice, which adjusts the radius of the spray arc. In operation, the top of the sprinkler nozzle moves upward when the arc adjustment is changed. Rotating spray nozzles are advantageous because they typically include a rotor that has a spray deflecting surface with varying characteristics that alter the radius of the spray arc as the rotor rotates, providing for greater uniformity of the spray pattern over a wider spray area. Rotating spray nozzles are also known that utilize fixed spray arcs, and other rotating spray nozzles are known that utilize spray arcs that are adjustable by a user within a range of up to about 210 degrees.

It would be desirable to provide a rotating sprinkler head valve that has a spray arc angle that is adjustable by a user from approximately zero to 360 degrees, and that does not alter the height of the nozzle upon adjustment of the spray arc. It would also be desirable to provide a rotating sprinkler head valve with detents for indicating predetermined spray arc settings, such as 90, 180, 270 and 360 degree settings, for example, with a nozzle orifice that is also adjustable to allow for adjustment of the radius of the spray arc pattern. It would also be desirable to provide a rotating sprinkler head valve with an internal mechanism that flushes debris from the rotating sprinkler head valve during onset of flow or cessation of flow through the valve. It would also be desirable to provide a slip clutch mechanism for the internal spray arc-setting elements to prevent cooperating flags on the elements from breaking in the event a user turns the internal spray arc-setting elements too far, allowing the elements to be turned continuously without breaking. The present invention meets these and other needs.

SUMMARY OF THE INVENTION

Briefly, and in general terms, the present invention provides for a rotating sprinkler head valve, including an upper assembly and a lower assembly, the upper assembly including a cylindrical shaft, a stationary rigid cone, and a rotor, the cylindrical shaft extending vertically and axially through the stationary rigid cone and the rotor, with the stationary rigid cone received in a conical interior chamber of the rotor, and the rotor being rotatable with respect to the cylindrical shaft and the stationary rigid cone. The lower assembly includes a generally tubular bottom helix member having an upper narrow tubular section at a top end of the bottom helix member and a lower generally tubular main body at a bottom end of the bottom helix member. The lower generally tubular main body includes an upper helical surface extending substantially completely around the upper narrow tubular section, and a vertical flag extending upwardly from the upper helical surface of the bottom helix member.

The lower assembly also includes a generally tubular strainer adapter having an internal transverse slotted plate extending transversely across the interior tubular chamber of the strainer adapter with a plurality of slots allowing flow through the strainer adapter, and a butterfly flow plate received in the strainer adapter. The butterfly flow plate includes opposing open slots configured to permit flow through the interior tubular chamber when they are aligned with the plurality of slots of the internal transverse slotted plate. The interior tubular chamber includes opposing flanges that receive the butterfly flow plate and permit rotation of the butterfly flow plate between a first position with the slots of the butterfly flow plate aligned with the slots of the internal transverse slotted plate allowing flow through the interior tubular chamber, and a second position with the slots of the butterfly flow plate not aligned with the plurality of slots of the internal transverse slotted plate to block flow through the interior tubular chamber.

The lower assembly also includes a short tubular base bottom member and a short tubular base top member that are joined to capture the bottom helix member and strainer adapter. The base bottom member includes an upper male portion, and a lower threaded portion configured to threadably engage a water supply conduit. The base top member includes an upper portion, and a lower portion including a downwardly extending inner tubular portion and a lower interior edge surface with a helical lower surface forming an adjustable helical aperture in cooperation with the bottom helix member. The base top member lower inner tubular portion has an interior surface defining a recessed inner helical lip along the lower interior edge surface of the downwardly extending inner tubular portion, and the recessed inner helical lip is configured to receive the upper helical surface of the bottom helix member, so that the recessed inner helical lip is rotatable with respect to the upper helical surface of the bottom helix member for adjusting the helical aperture. The upper male portion of the base bottom member typically includes an exterior annular rib, and the base top member upper portion includes an internal annular indentation that is configured to receive the exterior annular rib of the upper male portion.

In a presently preferred aspect, the cylindrical shaft includes an upper integral nut extending transversely to the longitudinal axis of the cylindrical shaft, and the stationary rigid cone includes an upper indentation configured to receive and engage the upper integral nut of the cylindrical shaft. The lower end of the cylindrical shaft is also typically flattened, and the central aperture of the butterfly flow plate has a corresponding rectangular shape configured to receive and engage the lower end of the cylindrical shaft.

In further aspects, the rigid cone has a wide upper portion and a lower tapered portion, and has an exterior surface defining a plurality of exterior grooves dividing the exterior surface of the rigid cone into a plurality of sections. A flexible rubber cone seal is also preferably disposed between the rotor and the stationary rigid cone, and the flexible rubber cone seal is configured to form a seal between the rigid cone and the rotor. In another aspect, the rotor typically has an exterior surface defining a plurality of exterior longitudinal grooves.

In a further aspect, a top cap is provided that has an outer annular rib, and the rotor includes a flared upper portion with an upper inner annular indentation configured to receive the outer annular rib of the top cap. Preferably the upper assembly is filled with silicone gel, and a sealing ring is disposed over the upper end of the cylindrical shaft between the top cap and the upper integral nut of the cylindrical shaft, with the sealing ring being configured to form a seal between the upper integral nut of the cylindrical shaft and the top cap, to retain silicone gel within the upper assembly.

In another presently preferred aspect, the generally tubular strainer adapter further includes a longitudinal tubular portion extending axially upwardly from a center portion of the internal transverse slotted plate, and the longitudinal tubular portion includes a cylindrical aperture therethrough configured to receive the cylindrical shaft. The base top member includes a cylindrical aperture therethrough including a vertical flag extending inwardly and configured to engage the vertical flag of the bottom helix member. The longitudinal tubular portion typically includes an octagonal exterior surface, and the lower portion of the aperture through the bottom helix member has an inner surface defining a corresponding internal octagonal hole configured to receive and engage the octagonal exterior surface of the longitudinal tubular portion of the transverse slotted plate, with a sufficient clearance defined between the octagonal exterior surface of the longitudinal tubular portion of the transverse slotted plate and the inner surface of the internal octagonal hole to allow the bottom helix member to rotate with respect to the longitudinal tubular portion of the transverse slotted plate when a predetermined amount of rotating force is applied by the flag of the base top member to the flag of the bottom helix member.

The generally tubular strainer adapter upper portion also typically includes a top end having an upper rim with a pair of opposing notches, and the short tubular base bottom member includes an internal surface defining a corresponding pair of upwardly directed opposing tabs configured to interlock with the pair of opposing notches of the top end of the generally tubular strainer adapter. The generally tubular strainer adapter lower portion also typically includes side notches configured to receive corresponding tab portions of a hollow strainer. In another presently preferred aspect, the rotating sprinkler head valve further includes a spinner member disposed between the lower surface of the rotor and the upper tubular surface of the upper narrow tubular section of the bottom helix member.

These and other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
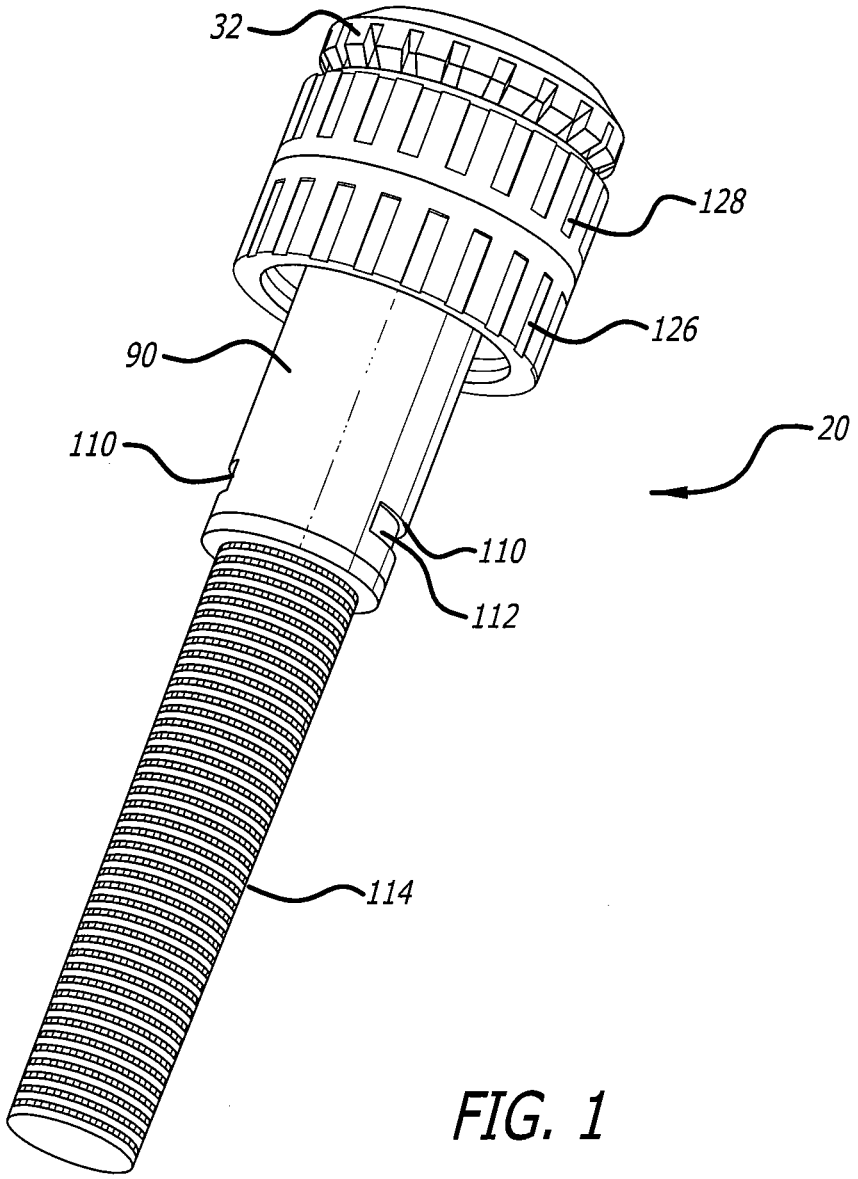
FIG. 1 is a perspective view of the rotating sprinkler head valve according to the present invention.
Figure 2:
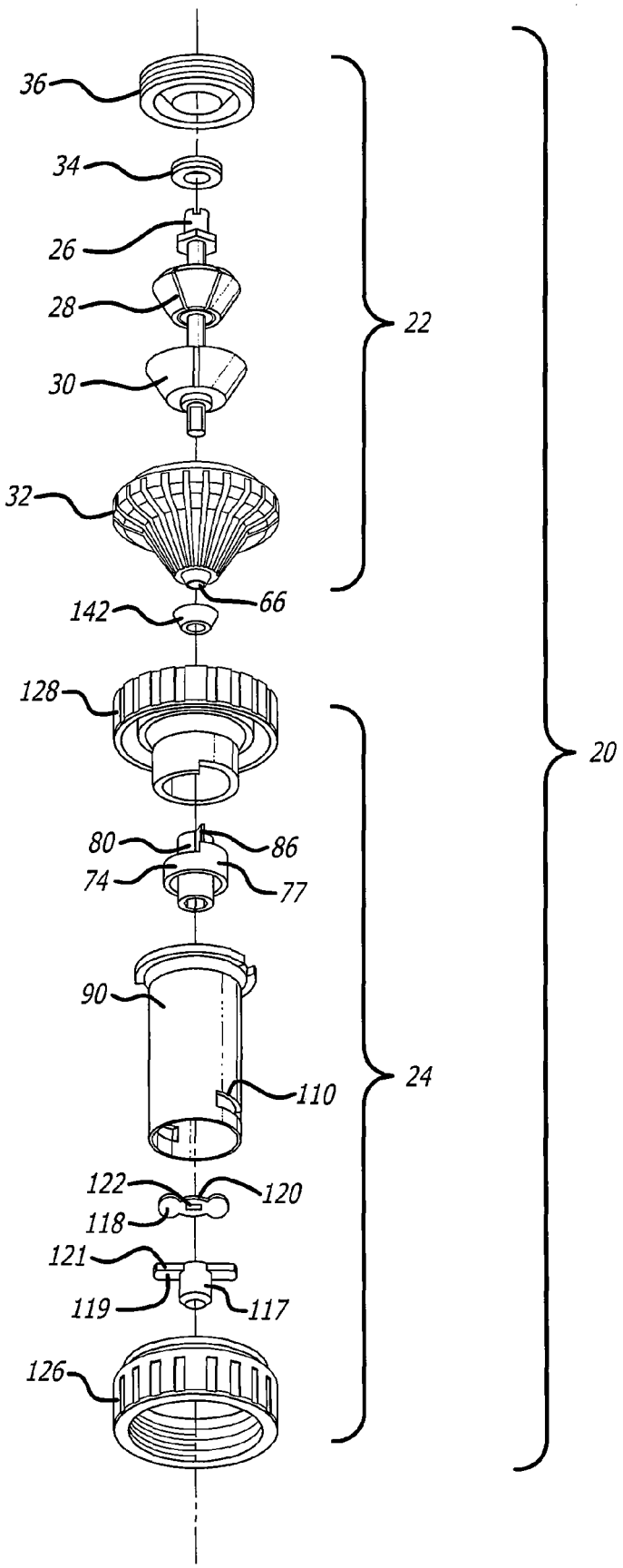
FIG. 2 is an exploded bottom perspective view of the rotating sprinkler head valve of FIG. 1.

As is illustrated in the drawings, the invention is embodied in a rotating sprinkler head valve, or rotating sprinkler 20, having an upper assembly 22 and a lower assembly 24. Referring to FIGS. 1-6, the upper assembly includes a cylindrical shaft 26, a stationary rigid cone 28, a rotor 32, a flexible rubber cone seal 30 disposed between the rotor and the stationary rigid cone, a quad ring or x-ring seal 34, and a top cap 36.

Figure 7:
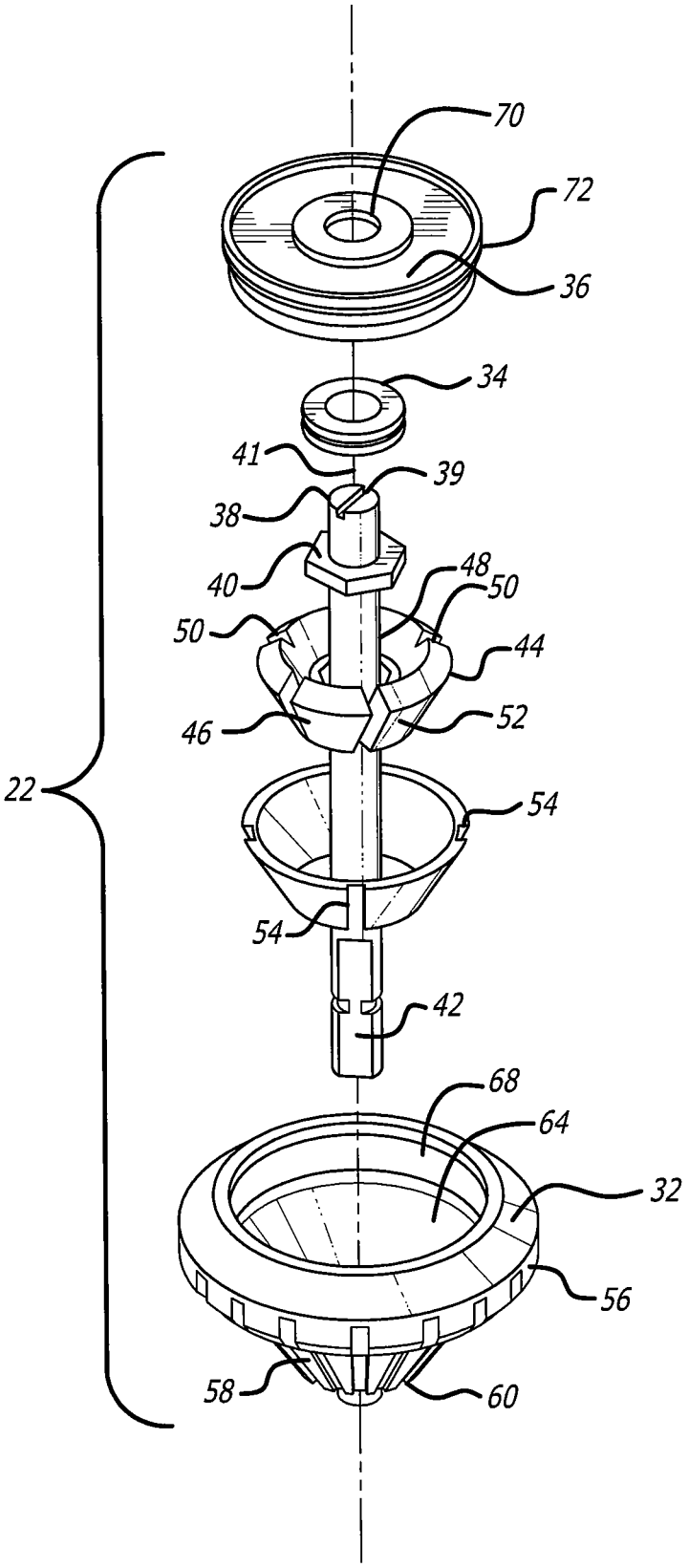
FIG. 7 is an enlarged exploded top perspective view of the upper assembly of the rotating sprinkler head valve of FIG. 1.
Figure 9:
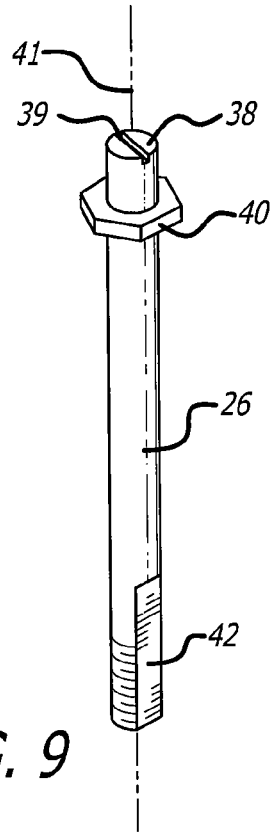
FIG. 9 is a top perspective view of the cylindrical shaft of the rotating sprinkler head valve of FIG. 1.

As is shown in greater detail in FIGS. 7 and 9, the cylindrical shaft has a top end 38 including a notch 39, and an upper portion including an upper integral hexagonal shoulder or nut 40 extending transversely to the longitudinal axis 41 of the cylindrical shaft. The cylindrical shaft also has a threaded, flattened lower end 42 with a generally rectangular configuration, as will be further explained below.

Figure 10:
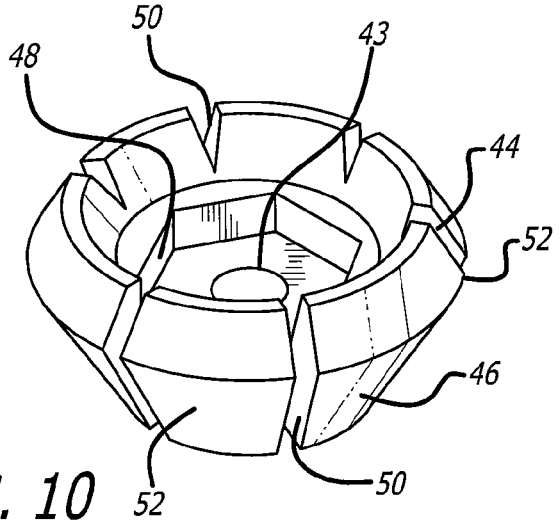
FIG. 10 is a top perspective view of the stationary rigid cone of the rotating sprinkler head valve of FIG. 1.

Referring further to FIGS. 7 and 10, the stationary rigid cone includes a central aperture 43 extending vertically and axially through the stationary rigid cone, through which the cylindrical shaft extends, with sufficient clearance so that the cylindrical shaft is rotatable with respect to the stationary rigid cone. The rigid cone has a wide upper portion 44 and a lower tapered portion 46, with the upper portion also including a typically hexagonal indentation 48 configured to receive and engage the upper integral nut of the cylindrical shaft. The rigid cone also typically has a plurality of exterior grooves 50, dividing the exterior surface of the rigid cone into sections 52, such as six, for example. As is shown in greater detail in FIG. 7, the flexible rubber cone seal also typically has a plurality of exterior grooves 54, such as four, for example.

Figure 11:
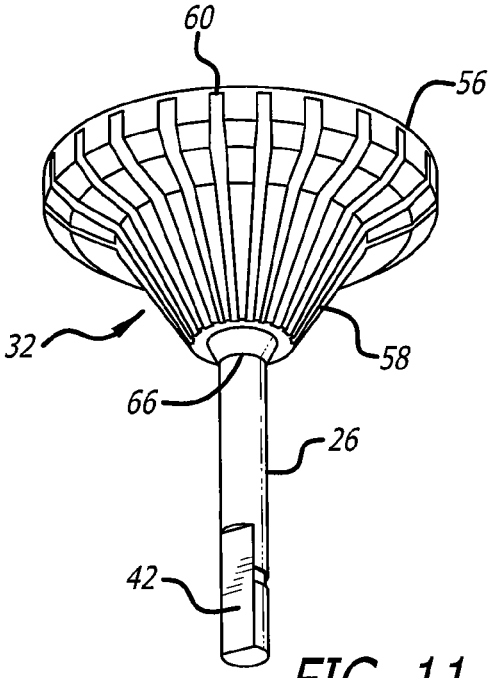
FIG. 11 is a bottom perspective view of the rotor partially assembled with the stationary rigid cone, seal and top cap of the rotating sprinkler head valve of FIG. 1.
Figure 12:
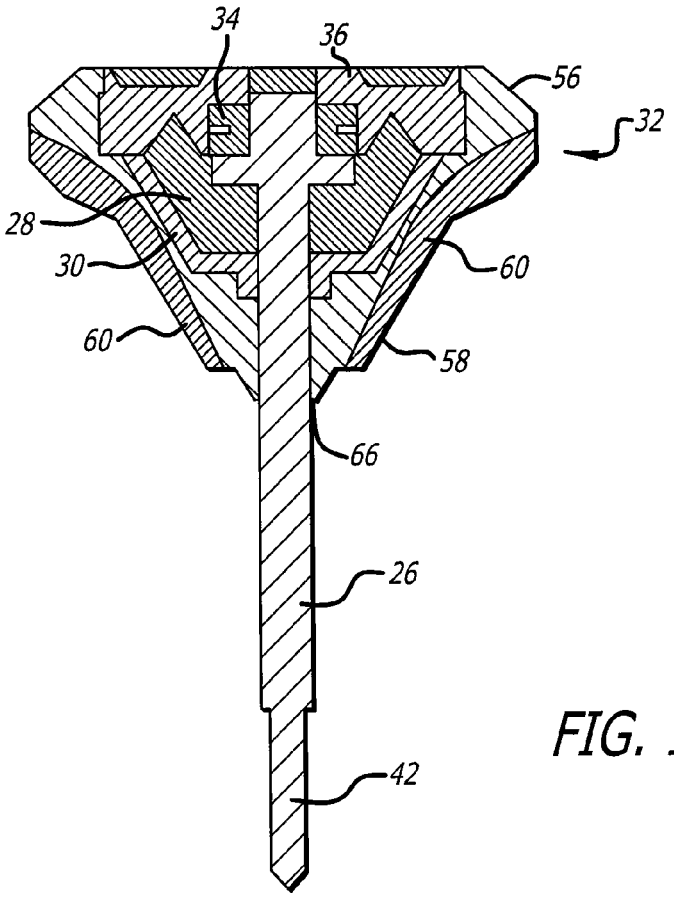
FIG. 12 is a cross-sectional view of the rotor partially assembled with the stationary rigid cone, seal and top cap as shown in FIG. 11.
Figure 14:
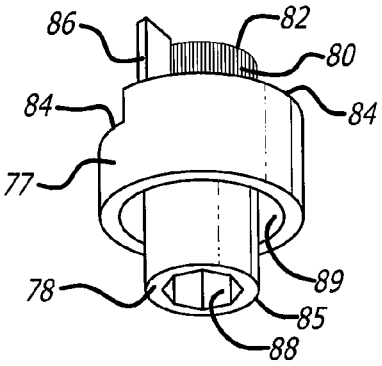
FIG. 14 is a bottom perspective view of a variation of the bottom helix member of the rotating sprinkler head valve of FIG. 1.

As is illustrated in greater detail in FIGS. 7, 11 and 12, the rotor has a wide upper portion 56 and a lower tapered portion 58 with exterior longitudinal grooves 60. The upper portion preferably includes a conical interior chamber 64 configured to rotatably receive the flexible rubber cone seal and the stationary rigid cone. The rotor also includes a bottom aperture 66 through which the cylindrical shaft extends. The upper portion of the rigid rotor also preferably includes an upper inner annular indentation 68, configured to receive an outer annular rib 72 of the top cap, as shown in greater detail in FIG. 7. The top cap also preferably includes a central aperture 70 allowing access to the notched upper end of the cylindrical shaft.

The upper assembly is typically assembled as a unit. The quad ring or x-ring seal is placed over the notched upper end of the shaft and is seated on top of the upper integral hexagonal shoulder or nut to form a seal between the shaft and the top cap, and the rigid cone, flexible rubber cone seal and rotor are placed over the lower portion of the shaft, respectively, with the flexible rubber cone seal forming a seal between the rigid cone and the rotor. The top cap is placed over the notched upper end of the shaft and over the quad ring or x-ring seal, so that the quad ring or x-ring seal forms a seal between the top cap and the upper portion of the shaft. Before the top cap is assembled the upper assembly is filled with silicone gel (not shown) and the cap is attached by way of a press fit and snap action. The quad ring or x-ring seal, along with the bottom part of the flexible rubber cone seal, act as seals to keep the silicone gel from being released from upper assembly.

The hexagonal shoulder or nut of the cylindrical shaft fits into the corresponding hexagonal indentation of the stationary rigid cone to keep the stationary rigid cone from rotating. The rotor will rotate, and the flexible rubber cone seal will slip and rotate within the silicone gel with respect to the stationary rigid cone as the rotor rotates. The top of the stationary rigid cone will slip against the top cap as the rotor and top cap rotate, and all of these locations that slip past each other as the rotor rotates are filled with silicone gel to provide a constant drag on the rotor.

Figure 5:
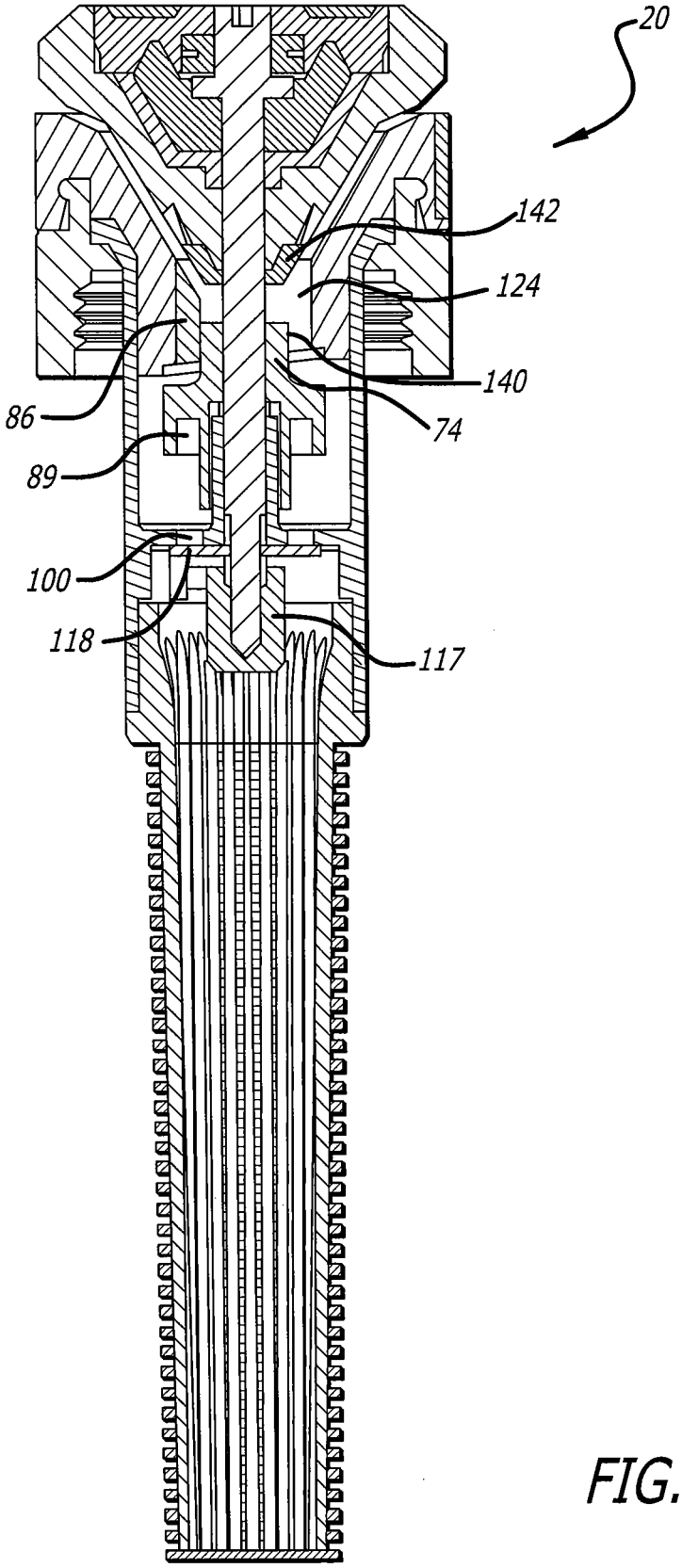
FIG. 5 is a cross-sectional view of the rotating sprinkler head valve taken along line 5-5 of FIG. 4B.
Figure 8:
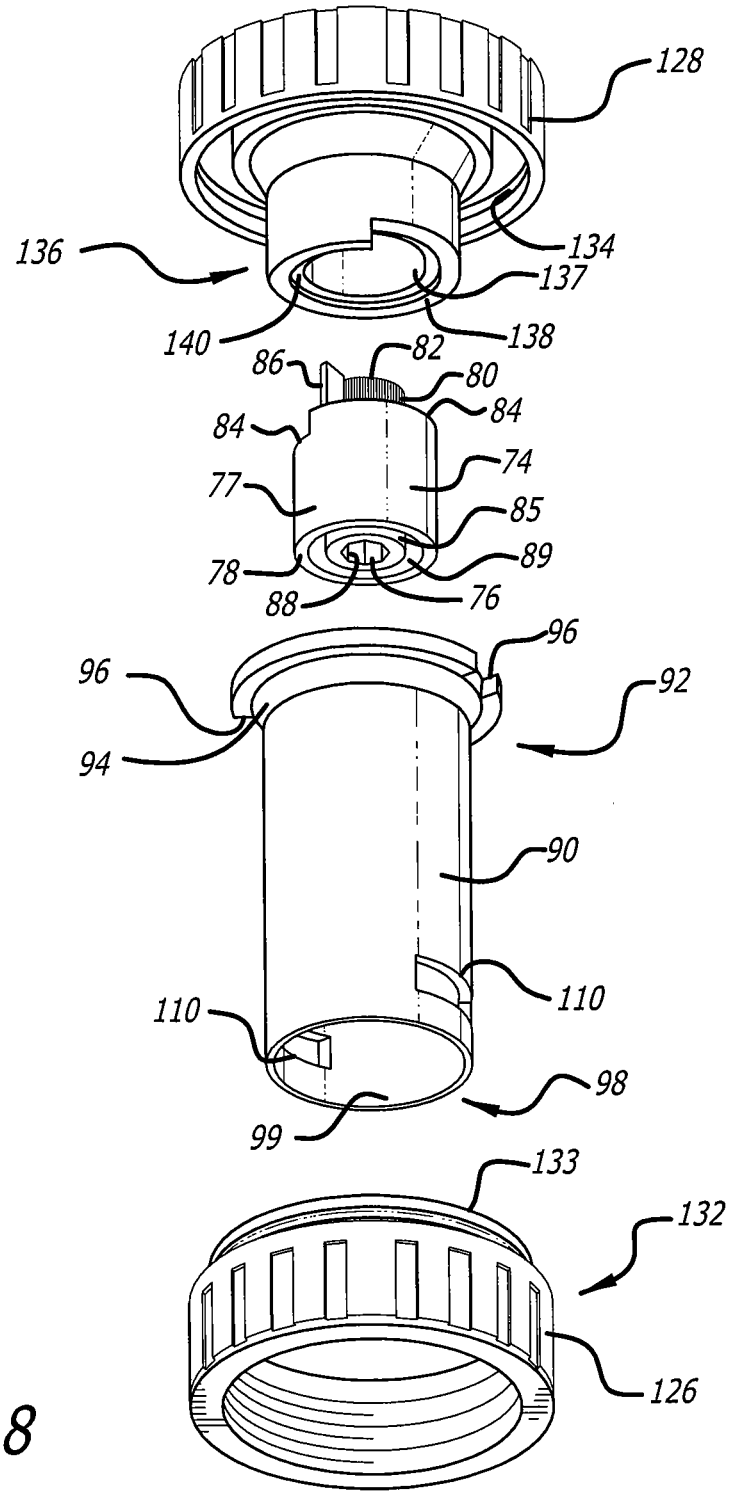
FIG. 8 is an enlarged exploded bottom perspective view of the lower assembly of the rotating sprinkler head valve of FIG. 1.

Referring to FIGS. 2, 3, 8 and 14, the lower assembly includes an inner lower section including a generally tubular bottom helix member 74 having a longitudinal aperture 76 therethrough that is configured to receive the cylindrical shaft, a lower generally tubular main body 77, a bottom end 78, an upper narrow tubular section 80, and a top end 82. Where the upper narrow tubular section and the lower generally tubular main body meet, the lower generally tubular main body has a helical or spiral surface or shoulder 84 or first helix extending substantially completely around the upper narrow tubular section, and a vertical flag 86 extending upwardly from the helical or spiral surface or shoulder of the bottom helix member. The lower portion 85 of the aperture through the bottom helix member preferably has an inner surface 87 defining an internal hole 88 with a geometric shape in cross-section, such as an octagonal shape, for example, although other shapes such as hexagonal, pentagonal, square, and the like may also be suitable, as will be further explained below. Referring to FIGS. 5 and 8, there is a cylinder ring space 89 between the outer wall of the generally tubular main hole and the generally tubular wall of the aperture of the bottom helix member that is configured to receive a compression spring (not shown) to bias the bottom helix member toward the base top member.

Figure 17:
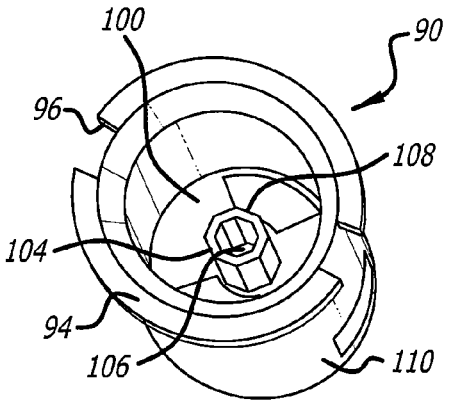
FIG. 17 is a top perspective view of the generally tubular strainer adapter of the rotating sprinkler head valve of FIG. 1.
Figure 18:
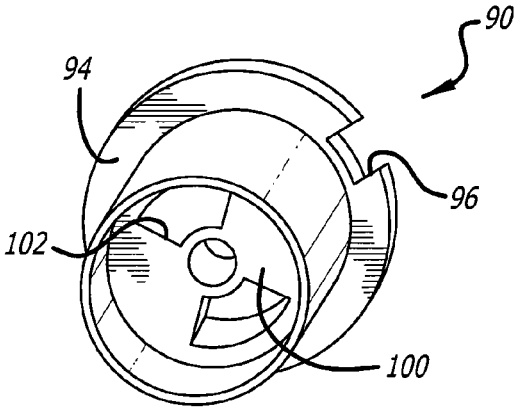
FIG. 18 is a bottom perspective view of the generally tubular strainer adapter of the rotating sprinkler head valve of FIG. 1.
Figure 19:
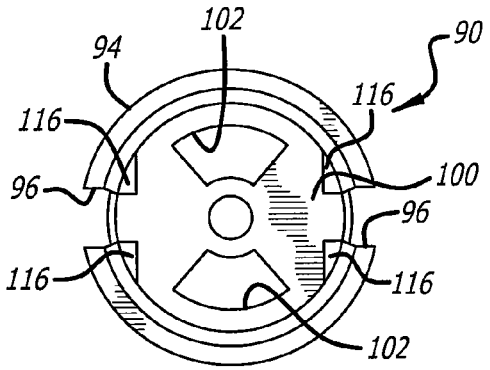
FIG. 19 is a bottom view of the generally tubular strainer adapter of the rotating sprinkler head valve of FIG. 1.

Referring to FIGS. 8 and 17-19, the lower assembly also includes a generally tubular strainer adapter 90 having a top end 92 with an upper rim 94 with opposing notches 96, a bottom end 98, and an interior tubular chamber 99. As is best seen in FIGS. 17-19, the generally tubular strainer adapter also includes an internal transverse slotted plate 100 with one or more slots 102, such as two slots, for example, allowing flow through the strainer adapter. As is best seen in FIG. 17, a longitudinal tubular portion 104 or pin of the generally tubular strainer adapter extends upwardly from the center of the internal transverse slotted plate and includes a cylindrical aperture 106 therethrough, and an exterior surface 108 with a geometric shape in cross-section corresponding to the shape of the internal hole of the bottom helix member, such as an octagonal shape, for example, although other shapes such as hexagonal, pentagonal, square, and the like may also be suitable. The internal hole of the bottom helix member is configured to receive the correspondingly shaped longitudinal tubular portion or pin of the generally tubular strainer adapter. In assembling the lower assembly, the bottom helix member is inserted into strainer adapter. When the tubular portion or pin and the hole of the bottom helix member have an octagonal shape, for example, the octagonal exterior surface longitudinal tubular portion or pin of the strainer adapter loosely mates with the corresponding octagonal interior hole of the bottom helix member. The octagon sides of the longitudinal tubular portion or pin stop the bottom helix member from rotating on the pin. However, there is a sufficient clearance between the two octagonal surfaces that allows the bottom helix member to rotate after a certain amount of rotating force is applied, allowing the bottom helix member and the strainer adapter to function in combination like a clutch mechanism.

Figure 3:
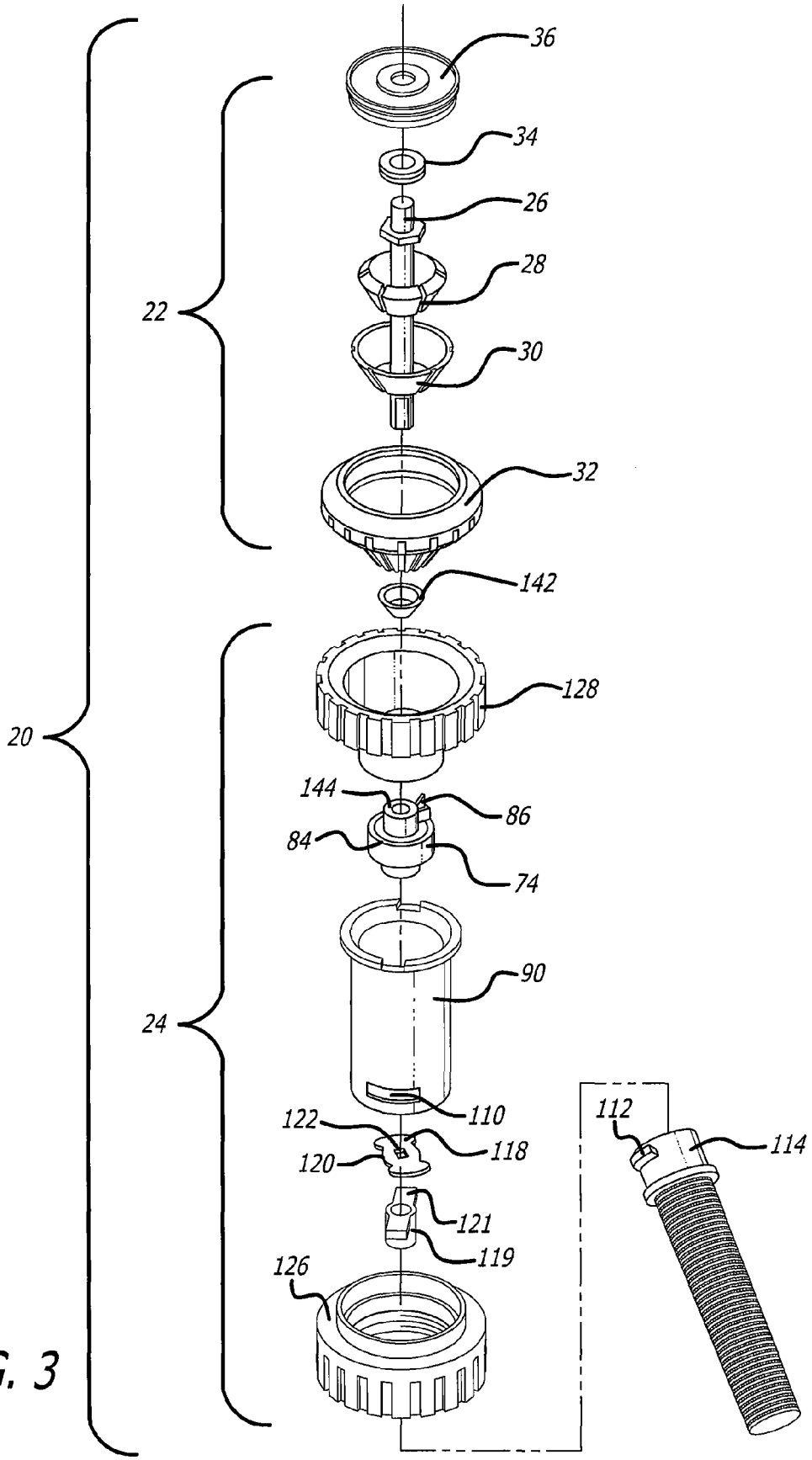
FIG. 3 is an exploded top perspective view of the rotating sprinkler head valve of FIG. 1.
Figure 4A:
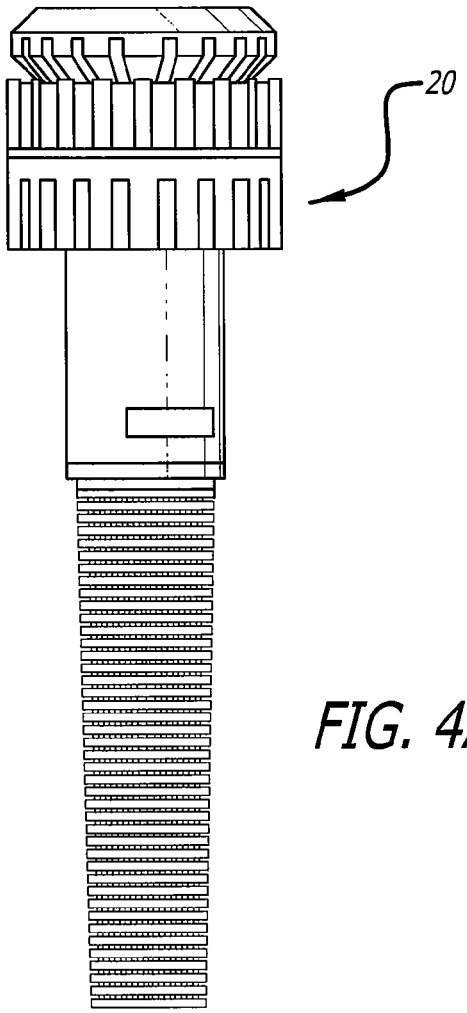
FIG. 4A is a side elevational view of the rotating sprinkler head valve of FIG. 1.
Figure 4B:
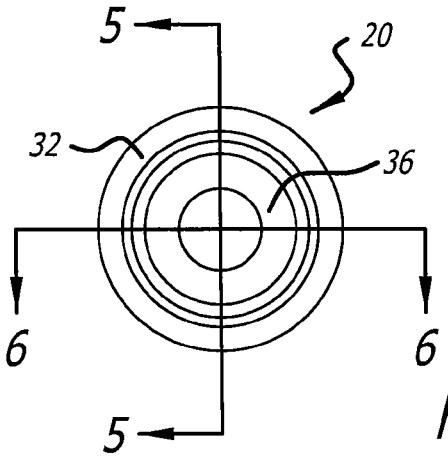
FIG. 4B is a top plan view of the rotating sprinkler head valve as shown in FIG. 4A.
Figure 6:
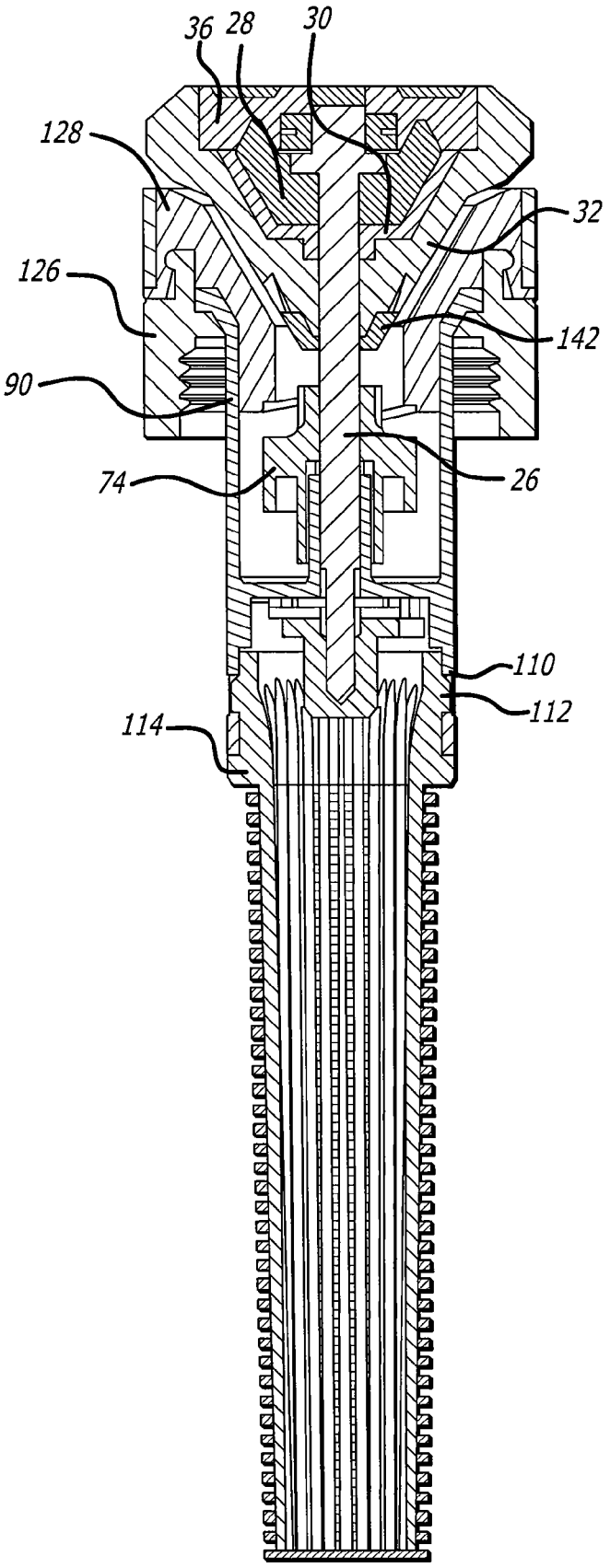
FIG. 6 is a cross-sectional view of the rotating sprinkler head valve taken along line 6-6 of FIG. 4B.

Referring to FIGS. 8 and 17, the lower portion of the strainer adapter also preferably includes side notches 110 for receiving corresponding tab portions 112 of a hollow strainer 114, as is shown in FIGS. 1 and 3, and as is shown in FIGS. 18 and 19, the interior surface of the lower portion of the strainer adapter includes opposing flanges 116 adapted to receive and retain a butterfly flow plate or disc 118. A flow plate keeper 119 having opposing tabs 121 may also be inserted over the butterfly flow plate or disc, with the opposing flanges of the strainer adapter configured to receive and retain the opposing tabs of the flow plate keeper over the butterfly flow plate or disc. The flow plate keeper may also include a generally tubular center portion 117 having a central threaded aperture for receiving the threaded end of the cylindrical shaft. The butterfly flow plate or disc includes opposing open slots 120 and a central rectangular aperture 122. When the cylindrical shaft flattened lower end is inserted through the central rectangular aperture, the butterfly flow plate or disc is received on and affixed to the cylindrical shaft flattened lower end and is located directly under the internal transverse slotted plate in the generally tubular strainer adapter. The butterfly flow plate or disc is configured to allow water to flow into the chamber 124 defined between the outside wall of the generally tubular strainer adapter and the outside surface of the bottom helix member, and between the outside surface of the generally annular base bottom member 126 and the inner surface of the generally annular base top member 128, as is illustrated in FIGS. 5 and 6, and as is further explained below. By inserting a flat blade screw driver in the notch at the notched end of the cylindrical shaft and rotating the cylindrical shaft, the cylindrical shaft thereby turns with the butterfly flow plate or disc attached to the bottom of the cylindrical shaft, causing the butterfly flow plate or disc to close the holes in the generally tubular strainer adapter internal transverse slotted plate. Closing the openings in the generally tubular strainer adapter internal transverse slotted plate in turn reduces the flow of water and will reduce the flow through the rotor flow paths, in turn reducing the throw of the water and reducing the diameter of discharge.

Figure 16:
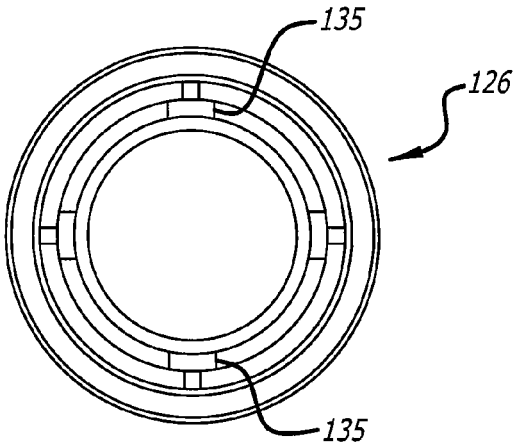
FIG. 16 is a bottom view of the generally tubular base bottom member of the rotating sprinkler head valve of FIG. 1.

Referring to FIGS. 8 and 16, the short tubular base bottom member includes an upper male portion 132 having an exterior surface that typically defining an exterior annular rib 133, and the base top member typically includes a corresponding lower portion with an internal annular indentation 134 that is configured to receive the exterior annular rib of the upper male portion. As is shown in FIG. 16, the short tubular base bottom member also includes an internal surface defining a pair of opposing tabs 135 configured to interlock with the pair of opposing notches of the top end of the generally tubular strainer adapter.

Figure 15:
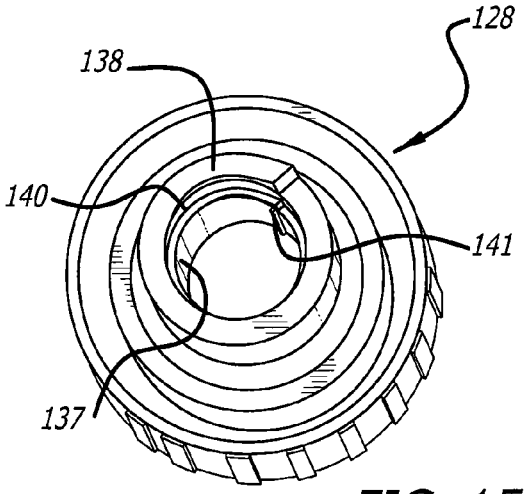
FIG. 15 is a bottom view of the generally tubular base top member of the rotating sprinkler head valve of FIG. 1.
Figure 13:
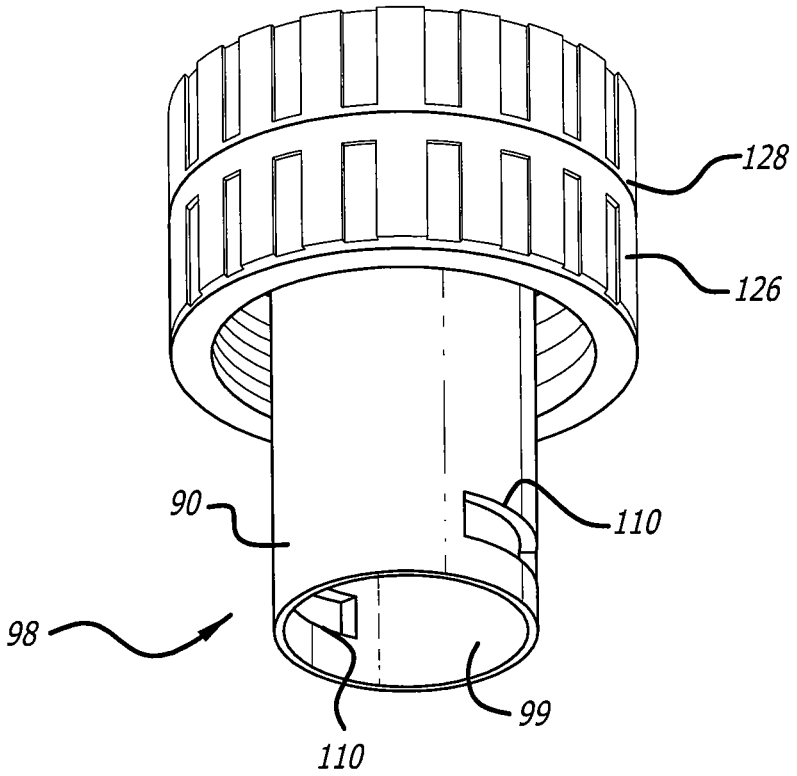
FIG. 13 is a bottom perspective view of the top and base members partially assembled with the generally tubular strainer adapter of the rotating sprinkler head valve of FIG. 1.

As is illustrated in FIGS. 8 and 15, the base top member includes a downwardly extending inner tubular portion 136 having a central aperture 137 extending axially through the base top member, and a helical or spiral lower surface forming a top helix 138 or second helix. A corresponding recessed inner helical lip 140 or third helix is defined along the lower interior edge surface of the downwardly extending inner tubular portion, that receives and is rotatable with respect to the upwardly directed first helix surface of the bottom helix member. As can best be seen in FIG. 15, the central aperture has an interior surface defining a vertical flag 141 extending inwardly and configured to engage the vertical flag of the bottom helix member. As is illustrated in FIGS. 2, 3, 5 and 6, a small conical, hollow spinner member 142 is inserted between the lower surface of the rotor and the upper tubular surface 144 of the upper narrow tubular section at the top end of the bottom helix member, to facilitate rotation of the rotor.

It will be apparent from the foregoing that, while particular forms of the invention have been illustrated and described, various modifications can be made without departing from the spirit and scope of the invention. Accordingly, it is not intended that the invention be limited, except as by the appended claims.

The invention claimed is:

1. An apparatus for restricting flow through a rotating sprinkler head valve, comprising:

a generally tubular bottom helix member having a top end and a bottom end, said generally tubular bottom helix member having a longitudinal aperture therethrough, an upper narrow tubular section at the top end, an upper helical surface extending substantially completely around the upper narrow tubular section, and a vertical flag extending upwardly from the upper helical surface of the bottom helix member;

a tubular base top member including a downwardly extending inner tubular portion and a lower interior edge surface with a helical lower surface forming an adjustable helical aperture in cooperation with said bottom helix member, said base top member including a cylindrical aperture therethrough including a vertical flag extending inwardly and configured to engage said vertical flag of said bottom helix member, and said base top member having an interior surface defining a recessed inner helical lip along said lower interior edge surface of the downwardly extending inner tubular portion, said recessed inner helical lip configured to receive said upper helical surface of the bottom helix member and said recessed inner helical lip being rotatable with respect to said upper helical surface of the bottom helix member for adjusting said helical aperture; and a generally tubular strainer adapter connected with said bottom helix member, said generally tubular strainer adapter having an interior tubular chamber extending through said generally tubular strainer adapter, an internal transverse slotted plate extending transversely across said interior tubular chamber, said internal transverse slotted plate including at least one slot configured to allow flow through the strainer adapter.

2. The apparatus of claim 1, further comprising:

a cone member having a central aperture;

a rotor having a central aperture, said rotor being rotatable with respect to said cone member; and a cylindrical shaft extending vertically through the central aperture and longitudinal aperture.

3. The apparatus of claim 2, wherein the cylindrical shaft has an upper end and a lower end, said cylindrical shaft extending vertically and axially through said central aperture of said cone member, said central aperture of said rotor, said longitudinal aperture of said bottom helix member, and said generally tubular strainer adapter, said internal transverse slotted plate including a central aperture configured to receive and engage said lower end of said cylindrical shaft, and said rotor being rotatable with respect to said cylindrical shaft.

4. The device of claim 1, further comprising a flow plate received in and extending transversely across said interior tubular chamber of said generally tubular strainer adapter, said flow plate including at least one slot configured to permit flow through said interior tubular chamber when aligned with said at least one slot of said internal transverse slotted plate.

5. The apparatus of claim 1, further comprising a tubular base bottom member including an upper male portion and a lower threaded portion, said upper male portion having an exterior surface that defines an exterior annular rib, and said lower threaded portion configured to threadably engage a water supply conduit, and said tubular base top member having a portion including an internal annular indentation that is configured to receive said exterior annular rib of the upper male portion of said tubular base bottom member.

6. The apparatus of claim 4, wherein said interior tubular chamber of said generally tubular strainer adapter has an interior surface including opposing flanges configured to receive said flow plate and permit rotation of said flow plate between a first position with said at least one slot of said flow plate aligned with said at least one slot of said internal transverse slotted plate allowing flow through said interior tubular chamber and a second position with said at least one slot of said flow plate not aligned with said at least one slot of said internal transverse slotted plate to block flow through said interior tubular chamber.

7. The apparatus of claim 3, wherein said cylindrical shaft includes an upper integral nut extending transversely to the longitudinal axis of the cylindrical shaft, and said cone member includes an upper indentation configured to receive and engage said upper integral nut of said cylindrical shaft.

8. The apparatus of claim 4, wherein said lower end of said cylindrical shaft is flattened, and said central aperture of said flow plate having a rectangular shape configured to receive and engage said lower end of said cylindrical shaft.

9. The apparatus of claim 7, wherein said cone member is a rigid cone having a wide upper portion and a lower tapered portion, and wherein said rigid cone has an exterior surface defining a plurality of exterior grooves dividing the exterior surface of the rigid cone into a plurality of sections.

10. The apparatus of claim 9, further comprising a flexible rubber cone seal disposed between said rotor and said rigid cone, said flexible rubber cone seal being configured to form a seal between the rigid cone and the rotor.

11. The apparatus of claim 2, wherein said rotor comprises an exterior surface defining a plurality of exterior longitudinal grooves.

12. The apparatus of claim 10, further comprising a top cap removably attached to an upper portion of said rotor.

13. The apparatus of claim 12, further comprising a sealing ring disposed over said upper end of said cylindrical shaft between said top cap and said upper integral nut of said cylindrical shaft, said sealing ring being configured to form a seal between the upper integral nut of said cylindrical shaft and said top cap.

14. The apparatus of claim 13, further comprising silicone gel disposed between said flexible rubber cone seal and said sealing ring.

15. The apparatus of claim 1, wherein said generally tubular strainer adapter further comprises a longitudinal tubular portion extending axially upwardly from a center portion of said internal transverse slotted plate, said longitudinal tubular portion including a cylindrical aperture therethrough configured to receive said cylindrical shaft, and said longitudinal tubular portion including an octagonal exterior surface, and wherein said lower portion of said aperture through said bottom helix member has an inner surface defining an internal octagonal hole configured to receive and engage said octagonal exterior surface of said longitudinal tubular portion of said transverse slotted plate, with a sufficient clearance defined between said octagonal exterior surface of said longitudinal tubular portion of said transverse slotted plate and said inner surface of said internal octagonal hole to allow said bottom helix member to rotate with respect to said longitudinal tubular portion of said transverse slotted plate when a predetermined amount of rotating force is applied by said flag of said base top member to said flag of said bottom helix member.

16. An apparatus for restricting flow within a rotating sprinkler head valve comprising:

an upper assembly and a lower assembly connected to said upper assembly, said lower assembly including a generally tubular bottom helix member, a tubular base bottom member and a short tubular base top member, said generally tubular bottom helix member having a top end and a bottom end, said generally tubular bottom helix member having a longitudinal aperture therethrough, an upper narrow tubular section at the top end, a lower generally tubular main body at the bottom end, the lower generally tubular main body having an upper helical surface extending substantially completely around the upper narrow tubular section, and a vertical flag extending upwardly from the upper helical surface of the bottom helix member, said tubular base bottom member including an upper male portion, and said short tubular base top member including an upper portion and a lower portion, said upper portion including an internal annular indentation that is configured to receive an exterior annular rib of the upper male portion of the tubular base bottom member, and said lower portion including a downwardly extending inner tubular portion and a lower interior edge surface with a helical lower surface forming an adjustable helical aperture in cooperation with said bottom helix member, and said base top member having an interior surface defining a recessed inner helical lip along said lower interior edge surface of the downwardly extending inner tubular portion, said recessed inner helical lip configured to receive said upper helical surface of the bottom helix member and said recessed inner helical lip being rotatable with respect to said upper helical surface of the bottom helix member for adjusting said helical aperture; and a generally tubular strainer adapter connected with said bottom helix member, said generally tubular strainer adapter having an upper portion, a lower portion, and an interior tubular chamber extending through said generally tubular strainer adapter and having an interior surface, an internal transverse slotted plate extending transversely across said interior tubular chamber including a plurality of slots allowing flow through the strainer adapter, said cylindrical shaft extending vertically and axially through said interior tubular chamber of said generally tubular strainer adapter.

17. The apparatus of claim 16, wherein said upper assembly comprises:

a cylindrical shaft having an upper end and a lower end;

a stationary rigid cone having a central aperture, said cylindrical shaft extending vertically and axially through said central aperture of said stationary rigid cone and longitudinal aperture; and a rotor having a wide upper portion and a lower tapered portion, a conical interior chamber and a bottom central aperture, said cylindrical shaft extending vertically and axially through said bottom central aperture of said rotor, and said stationary rigid cone received in said conical interior chamber of said rotor, said rotor being rotatable with respect to said cylindrical shaft and said stationary rigid cone.

18. The apparatus of claim 16, further comprising a butterfly flow plate received in and extending transversely across said interior tubular chamber of said generally tubular strainer adapter, said butterfly flow plate including opposing open slots configured to permit flow through said interior tubular chamber when aligned with said plurality of slots of said internal transverse slotted plate, said butterfly flow plate including a central aperture configured to receive and engage said lower end of said cylindrical shaft, the interior surface of the interior tubular chamber including opposing flanges configured to receive said butterfly flow plate and permit rotation of said butterfly flow plate between a first position with said open slot of said butterfly flow plate aligned with said plurality of slots of said internal transverse slotted plate allowing flow through said interior tubular chamber and a second position with said open slot of said butterfly flow plate not aligned with said plurality of slots of said internal transverse slotted plate to block flow through said interior tubular chamber.

* * * * *